US005605188A

United States Patent [19]

Banny et al.

[11] Patent Number: 5,605,188

[45] Date of Patent: Feb. 25, 1997

[54] METHOD AND DEVICE FOR REGULATING THE LEVEL OF LIQUID METAL IN A MOLD FOR THE CONTINUOUS CASTING OF METALS

[75] Inventors: Thierry Banny, Tressange; Joël Drouot, Angers; Jean-François Martin, Chateauneuf les Martigues; Michèle Nadif, Metz; Didier Becler, Lantefontaine; Hervé Dusser, Metz; Alain Mouchette, Semecourt; Odile Thomardel, Marbach, all of France

[73] Assignee: Sollac (Societe Anonyme), Puteaux, France

[21] Appl. No.: 513,870

[22] PCT Filed: Mar. 17, 1994

[86] PCT No.: PCT/FR94/00292

§ 371 Date: Oct. 23, 1995

§ 102(e) Date: Oct. 23, 1995

[87] PCT Pub. No.: WO94/22618

PCT Pub. Date: Oct. 13, 1994

[30] Foreign Application Priority Data

Mar. 30, 1993 [FR] France ..... 93 03872

[51] Int. Cl.[6] ..... B22D 11/18; B22D 11/16

[52] U.S. Cl. ..... 164/453; 164/151.3; 164/450.5

[58] Field of Search ..... 164/453, 450.2, 164/450.4, 151.3, 450.5

[56] References Cited

FOREIGN PATENT DOCUMENTS

| | | | |
|---|---|---|---|
| 60-216959 | 3/1985 | Japan . | |
| 63-188463 | 12/1988 | Japan . | |
| 2-137655 | 8/1990 | Japan . | |
| 4-143055 | 5/1992 | Japan | 164/151.3 |
| 4-339551 | 11/1992 | Japan | 164/151.3 |
| 6-000610 | 1/1994 | Japan | 164/453 |

*Primary Examiner*—Joseph J. Hail, III
*Assistant Examiner*—I.-H. Lin
*Attorney, Agent, or Firm*—Sixbey Friedman Leedom & Ferguson; Thomas W. Cole

[57] ABSTRACT

The subject of the invention is a method for regulating the level of the meniscus (13) of the liquid metal in a mold (5) of a machine for the continuous casting of metals, according to which method the electrical signals supplied by at least one pair of sensors (17, 18) overhanging said meniscus are picked up, said signals being a function of the respective distances ($h_1$, $h_2$) between said sensors and said meniscus, these two signals are combined so as to obtain a single signal representing an imaginary level of said meniscus and said signal is sent to means (15, 24) for controlling a device (14) for regulating the flow rate of metal penetrating the mold, so that said control means actuate said device so as to bring said imaginary level of said meniscus back to a predetermined set value (h), wherein each signal coming from said sensors is conditioned, eliminating therefrom the oscillations having both a frequency greater than a threshold (F) and an amplitude less than a threshold (D). The invention also relates to a mode of combining said signals and a device for implementing said method.

8 Claims, 1 Drawing Sheet

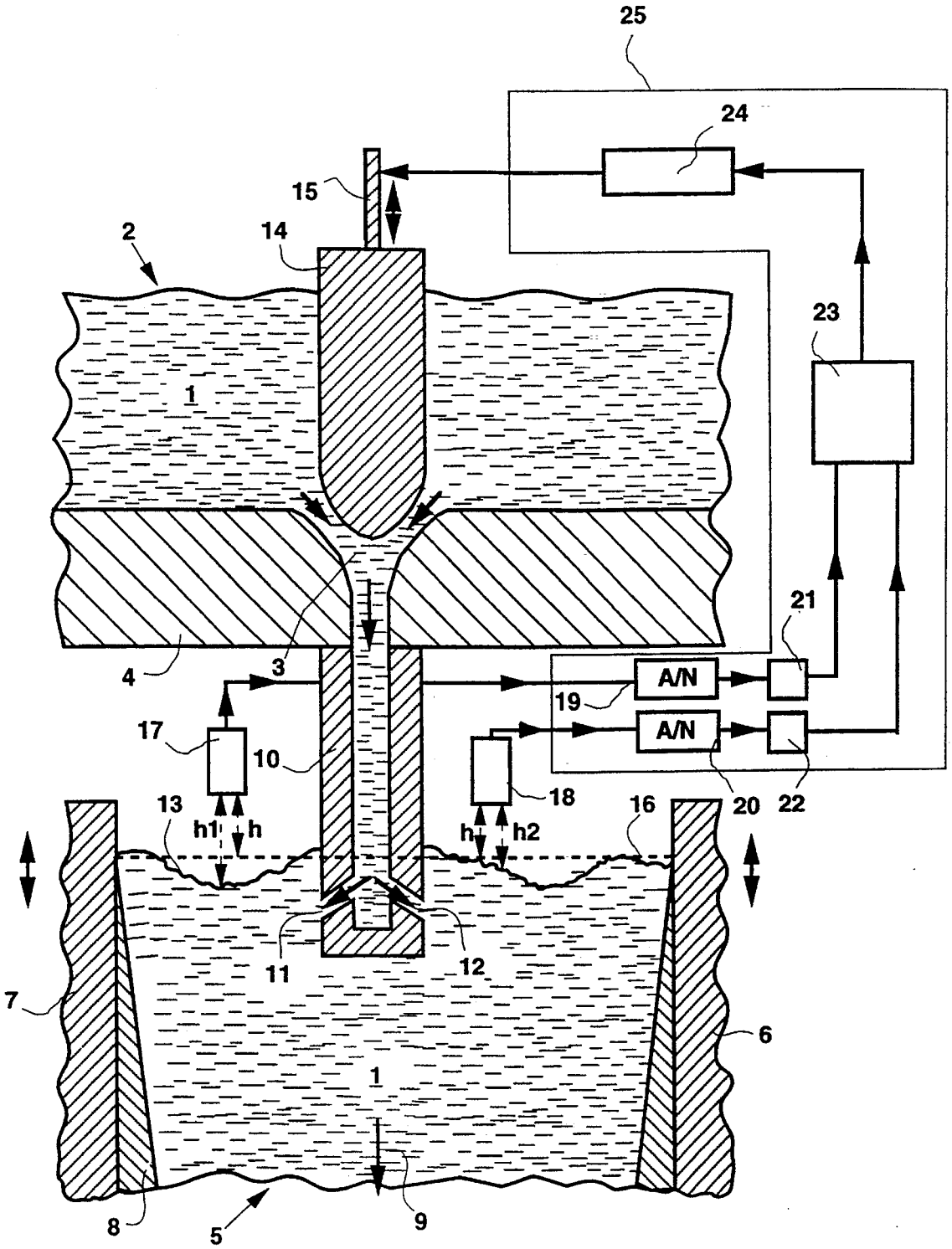
25
24
15
2
14
23
1
21
4
3
A/N
19
A/N
17
10
18
20
22
13
h1
h
h
h2
16
11
12
7
6
1
8
5
9

METHOD AND DEVICE FOR REGULATING THE LEVEL OF LIQUID METAL IN A MOLD FOR THE CONTINUOUS CASTING OF METALS

CROSS-REFERENCE TO RELATED APPLICATION

This application is A 371 OF PCT/FR94/00292, filled Mar. 17, 1994.

FIELD OF THE INVENTION

The invention relates to the field of the continuous casting of metals, especially steel. More precisely, it relates to the regulating of the level of the liquid metal present in a continuous casting mold.

In an installation for a continuous casting of steel, the liquid metal which flows out of the pouring ladle firstly passes via an intermediate vessel, called a tundish. One of the roles of the tundish is to direct the liquid metal toward the single oscillating mold or, more generally, the multiple oscillating molds of the continuous casting machine, in which molds the ferro-metallurgical products (slabs, blooms or billets) start to solidify. Above each mold, the metal flows out from the tundish via an outlet orifice and thus forms a casting stream which penetrates the mold by passing through the meniscus, that is to say the surface of the liquid metal present in the mold. On its travel between the tundish and the mold, the casting stream is confined in a tube made of refractory material, called a casting nozzle. The upper end of the nozzle is fixed to the bottom of the tundish, while its lower end passes through the meniscus and dips into the liquid metal. The functions of the nozzle are to protect the stream of liquid metal from being oxidized by the atmosphere, to prevent the stream, as it passes through the meniscus, from entraining with it part of the covering slag which covers the meniscus, which entrainment would cause the cleanness of the cast product to deteriorate, and finally to force the flow of liquid metal in the mold to adopt a configuration favorable to satisfactory solidification of the product. For this reason, its lower end may include a multiplicity of lateral orifices (or slots), each directed toward one or other of the faces of the mold.

One of the essential parameters in obtaining a sound product is the stability of the level of the meniscus in the mold. If this stability is not satisfactorily ensured, solidification of the product takes place under excessively variable conditions. It is thus possible to end up with a solidified thickness of the product which is locally too small, hence a risk of tears of varying magnitude in the solidified skin. At best, the end product is of poor surface quality; at worst, liquid metal can flow out through the tears (a phenomenon called "breakout") and cause a halt to the casting and serious damage to the machine. The mean level of the meniscus is determined by the flow rate of steel flowing out of the tundish and by the speed at which the solidifying product is extracted from the mold. The flow rate of liquid steel penetrating the mold is generally regulated by a refractory stopper rod, the conical tip of which closes off to a greater or lesser extent the outlet orifice of the tundish. Even though it is desired to keep this flow rate to a constant value, it is necessary to vary the position of the tip of the stopper rod in order to take into account steady or abrupt changes in the other casting parameters. These changes may, for example, be a variation in the height of the metal in the tundish, the progressive wear of the slots in the nozzle, or their blockage by nonmetallic inclusions, or their sudden unblocking if these inclusions become dislodged from the walls. In order to regulate the level of liquid metal in the mold satisfactorily, it is essential to use an automatic system which controls the position of the stopper rod. It moves the latter depending on the results of a comparison between the desired level of the meniscus and that actually measured. This level measurement is normally carried out by means of a single inductive or optical sensor. It supplies an electrical signal which, after processing, is used to control the position of the stopper rod.

It is in the case of the continuous casting of slabs that the problem of regulating the level of the meniscus is most complicated. The reason for this is that these molds are long and narrow and, at a given instant, the fluctuations in the level of the meniscus can be greatly different from one region of the mold to another. The information supplied by a single sensor is therefore not necessarily representative of the fluctuations in the level of the meniscus. Moreover, on these machines, the lower end of the nozzle usually includes two diametrally opposed slots, each of which directs a fraction of the metal stream toward one of the small faces of the mold. Now these two slots do not necessarily get blocked or widen in the same way throughout casting. The flows into the molds may therefore vary unsymmetrically and the undulations which affect the meniscus therefore have very different configurations on either side of the nozzle at a given instant. In particular, when one of the slots suddenly becomes unblocked, even if this unblocking takes place on that side of the nozzle where the sensor is, the latter attributes an exaggerated importance to the corresponding perturbation compared to the actual variation in the mean level of the meniscus that it causes. Conversely, if the unblocking takes place on the side opposite that where the sensor is, the latter does not detect the perturbation at the time when it occurs, or only in a highly attenuated manner. In both cases, the stopper rod cannot be controlled in the manner most appropriate to reacting to this event.

PRIOR ART

It has been proposed (see Document JP 02 137655) to use for this purpose not just one, but two sensors, each located on either side of the nozzle and moving along the longitudinal axis of the mold. The rate of casting is controlled as a function of the simple difference between the signals delivered by each of the sensors. Although this represents progress compared to the configuration having a single sensor, such a device is still insufficient to take into account in a satisfactory manner (neither overestimating nor underestimating) all the perturbations in the meniscus.

SUMMARY OF THE INVENTION

The object of the invention is to propose a method for regulating the level of liquid metal which takes into account the local perturbations in the meniscus, correctly estimating their actual influence on the mean level of liquid metal in the mold, and which makes it possible to decrease substantially the amplitude of the fluctuations in the level of the meniscus which are deleterious for the quality of the slabs, taking the entire meniscus into account.

For this purpose, the subject of the invention is a method for regulating the level of the meniscus of the liquid metal in a mold of a machine for the continuous casting of metals, according to which method the electrical signals supplied by at least one pair of sensors overhanging said meniscus are picked up, said signals being a function of the respective distances ($h_1$, $h_2$) between said sensors and said meniscus, these two signals are combined so as to obtain a single signal representing an imaginary level of said meniscus and said signal is sent to means for controlling a device for regulating the flow rate of metal penetrating the mold, so that said control means actuate said device so as to bring said imaginary level of said meniscus back to a predetermined set value (h), wherein each signal coming from said sensors is conditioned, eliminating therefrom the oscillations having both a frequency greater than a threshold (F) and an amplitude less than a threshold (D).

Preferably, said signals are combined in the following manner:

the quantity $$\left(\overline{M}=\frac{h_1+h_2-2h}{2}\right)$$

and its absolute value ($|\overline{M}|$) are calculated;

($|\overline{M}|$) is compared to two predetermined values ($diff_{min}$) and ($diff_{max}$), where $diff_{min}<diff_{max}$;

if $|\overline{M}|\leqq diff_{min}$, said imaginary level is taken to be equal to $\overline{M}$;

if $|\overline{M}|\geqq diff_{max}$, said imaginary level is taken to be equal to a value ($\Delta h_{max}$) which is the higher in absolute value of the quantities [($h_1$–h), ($h_2$–h)];

if $diff_{min}<|\overline{M}|<diff_{max}$, said imaginary level is taken to be equal to $\alpha\Delta h_{max}+(1-\alpha)\overline{M}$, $\alpha$ being equal to $$\frac{(|\overline{M}|-diff_{min})}{(diff_{max}-diff_{min})}.$$

The subject of the invention is also a device for implementing this method.

As will have been understood, the invention consists in conditioning the signals coming from these sensors prior to combining them, eliminating from these signals the high-frequency and low-amplitude oscillations and combining these signals into a single signal in an appropriate manner.

BRIEF DESCRIPTION OF THE DRAWINGS

The invention will be better understood on reading the following description given with reference to the appended single FIGURE. The latter shows diagrammatically a cross section of a tundish and of a slab continuous casting mold equipped with a device according to the invention.

DESCRIPTION OF THE PREFERRED EMBODIMENTS

Liquid steel 1 contained in a tundish 2 flows out via an outlet orifice 3, made in the bottom 4 of the tundish 2, into a bottomless oscillating mold 5. The side walls 6, 7 of the mold 2 are vigorously cooled by an internal circulation of water. A solidified crust 8 starts to form against these walls 6, 7. This crust progressively takes up the entire cross section of the cast slab as it is extracted from the machine, as shown symbolically by the arrow 9. On its travel between the tundish 2 and the mold 5, the liquid steel 1 is protected by a tubular nozzle 10 made of a refractory material such as graphitized alumina. The upper part of the nozzle 10 is fixed against the bottom 4 of the tundish 1, in the extension of the outlet orifice 3. The lower part of the nozzle 10 is provided with two lateral slots 11, 12 via which the liquid steel 1 flows out, each being directed toward one of the walls 7. The nozzle 10 passes through the meniscus 13 so as to bring the liquid metal 1 to the core of the mold 5 (for reasons of clarity of the drawing, its slag layer normally covering the meniscus 13 has not been shown). The orifice 3 is partially closed off (or completely closed off when the casting is stopped) by a stopper rod 14 having a roughly conoid end, the vertical position of which is regulated by a device 15. The vertical position of the stopper rod 14, corresponding to the value of the rate of extraction of the slab out of the mold 5, determines the mean level at which the meniscus 13 lies in the mold 5. The set value 16 that it is desired to maintain permanently during casting of the slab has therefore been indicated by the dotted line.

This is maintained by means of a device which will now be described. It firstly comprises two level sensors 17, 18 of a type known per se, for example eddy-current sensors. They are located on either side of the nozzle 10, preferably at equal distances from the nozzle 10 and above the major mid-axis of the cross section of the mold 5. In the general case, their lower ends are located at the same heights. The sensor 17 delivers an electrical signal representing the distance $h_1$ between its lower end and the meniscus 13 and the sensor 18 delivers an electrical signal representing the distance $h_2$ between its lower end and the meniscus 13. In the ideal case, these distances $h_1$, $h_2$ would be equal to the distance h between the lower ends of the sensors 17, 18 and the set level 16. In practice, this is very rarely the case, since the meniscus 13 always exhibits undulations having amplitudes of varying magnitude, as a function of the variations in the flow rate of liquid metal 1 leaving the nozzle 10, of the oscillation of the mold 5, of the variations in the rate of extraction of the product, etc. As these undulations are virtually never completely symmetrical (especially because of the fact that the wear or the blockages of the slots 11, 12 can be substantially different), $h_1$ and $h_2$ are generally not equal. This explains why reliable regulation of the meniscus level 13 is impossible to achieve, as mentioned above, when basing this only on the information delivered by a single sensor.

The analog signals delivered by the sensors 17, 18 are sent to analog-to-digital converters 19, 20, from which they emerge digitized. Each of these digitized signals is sent to a digital filter device 21, 22 which operates in the following manner. The signals emitted by the sensors 17, 18 and representing the variations in the level of the meniscus 13 which they detect are the superposition of many undulations of various frequencies and amplitudes. There are low-frequency undulations, with frequencies less than a threshold arbitrarily fixed at 0.02 Hz, and undulations at higher frequencies, greater than 0.02 Hz and possibly reaching a few Hz.

It is considered that, for correctly regulating the level of the meniscus 13, it is preferable not to take into account the perturbations which have both a high frequency (greater than 0.02 Hz) and a low amplitude. The reason for this is that it is the low-frequency perturbations (frequency less than 0.02 Hz) and the perturbations having a high frequency but of high amplitude which are regarded as being deleterious for the surface quality of the slabs. Not taking into account the high-frequency low-amplitude perturbations makes it possible not to stress excessively and unnecessarily the device for regulating the liquid-metal flow rate, and to limit its wear. In order to eliminate these perturbations from the processed signals, each of them is sent to a conditioning device 21, 22. These conditioning devices 21, 22 are identical and operate in the following manner. The signal from each sensor 17, 18, after having been digitized by one of the converters 19, 20, is processed by a low-pass filter which removes or at least highly attenuates the signals having a frequency greater than a threshold F which is fixed, for example, at 0.02 Hz. Next, the remaining low frequencies are subtracted from the original, non-filtered, signal in order to obtain a new signal now containing substantially only the highest frequencies of the original signal. Next, this new signal passes through a dead band which highly attenuates or removes those components of the signal whose amplitude does not exceed a predetermined threshold D, taken for example to be equal to 3 mm. Finally, the low frequencies taken from the output of the low-pass filter are added to the signal thus treated. In this way, a signal conforming to the original signal delivered by the sensor 17, 18 is reconstituted, except that the components having both a high frequency (greater than F=0.02 Hz) and a low amplitude (less than D=3 mm) have been eliminated therefrom.

Next, the signals thus reconstituted are sent into a combining device 23, in order for them to be combined into a single signal which is a synthesis of them, so as to supply the information necessary for controlling the stopper rod 14. This signal constitutes as it were an imaginary mean level for the metal in the mold. It is sent to a digital regulator 24 which supplies in turn, to the device 15, a signal which enables it to regulate in a suitable manner the position of the tip of the stopper rod 14 in the outlet orifice 3, and therefore the flow rate of liquid metal penetrating the mold 5. The intention is therefore to bring the imaginary level of the liquid metal in the mold back to the set value, if a difference is detected between them.

Advantageously, the converters 19, 20, the conditioning devices 21, 22, the combining device 23 and the regulator 24 may be arranged inside the same casing 25. The devices downstream of the converters 19, 20 may even be formed by a single digital processing card designed and programmed to accomplish each of their functions.

The choice of the way in which the signals are combined in the device 23 is of great importance for the quality of the final result, that is to say a suitable regulation of the level of the meniscus 13. It could be enough just to take as signal for controlling the stopper rod 14 the simple average of the signals picked up by each sensor, and representing the deviations in the level from the set value. However, there is then a risk of minimizing the importance of a large perturbation as it is limited just to one side of the mold. It is therefore advantageous to combine these two signals in a more complex manner. However, care should be taken not to go to the other extreme by ascribing an excessive importance to a perturbation of average amplitude limited to just one side. One would then be back to the shortcomings of the single-sensor regulating systems described previously.

For this purpose, the inventors have proposed the following method, which gives satisfactory results. As explained previously, h defines the distance ideally to be maintained between the meniscus 13 and the sensors 17, 18, this distance corresponding to the set level 16. Likewise, $h_1$ and $h_2$ define respectively the distances measured between the sensors 17 and 18 and the meniscus 13. The differences $(h_1-h)$ and $(h_2-h)$ represent the deviations in the levels of the metal in the mold opposite below the sensors 17, 18 from the set value 16. If these differences are positive, the metal level at the point of measurement is below the set level 16. If they are negative, the metal level at the point of measurement is above the set level.

The combining device firstly calculates, at a time t, the arithmetic mean $\overline{M}$ of $(h_1-h)$ and $(h_2-h)$, i.e.

$$\overline{M}=\frac{h_1+h_2-2h}{2}.$$

Next, the absolute value of $\overline{M}$, termed $|\overline{M}|$, is compared with two predetermined values that it can take, the smaller one of which is termed $diff_{min}$ and the larger one is termed $diff_{max}$. Three cases may then occur.

1) If $|\overline{M}|\leqq diff_{min}$, the signal sent to the regulator 24 corresponds to $\overline{M}$. The deviation from the set level 16 is therefore considered to be suitably represented by the simple arithmetic mean of the distances measured by each of the sensors 17, 18.

2) If $|\overline{M}|\geqq diff_{max}$, the signal sent to the regulator 24 corresponds to the higher, in absolute value, of the differences $(h_1-h)$ and $(h_2-h)$, termed $\Delta h_{max}$. Only that difference corresponding to the largest deviation from the set value is then taken into account.

3) If $diff_{min}<|\overline{M}|<diff_{max}$, the signal sent to the regulator 24 corresponds to a compromise between $\overline{M}$ and $\Delta h_{max}$, calculated so as to ensure a progressive transition between the two previous modes of regulation. For this purpose, this signal is taken to be equal to $\alpha\Delta h_{max}+(1-\alpha)\overline{M}$, $\alpha$ being defined by:

$$\alpha=\frac{(|\overline{M}|-diff_{min})}{(diff_{max}-diff_{min})}$$

Following these calculations, the regulator 24 and the control means 15 impose a displacement on the stopper rod 14 in such a way as to aim to correct the deviation between the set value 16 and the imaginary level represented by the signal coming from the combining device, this signal being derived as has just been explained. Next, the operation is repeated at a time $t+\Delta t$, $\Delta t$ being, for example, equal to 0.1 sec, and in this way the level of liquid metal in the mold is regulated in a quasi-continuous manner.

By way of example, it is assumed that the set level 16 is at a distance h=75 mm from the two sensors 17, 18. Moreover, let $diff_{min}$=1 mm and $diff_{max}$=5 mm.

a) If the sensor 17 measures $h_1$=70 mm and the sensor 18 measures $h_2$=79 mm, then $(h_1-h)$=−5 mm and $(h_2-h)$=+4 mm. $\overline{M}$ is thus −0.5 mm. Since $|\overline{M}|$=0.5 mm is less than $diff_{min}$, the regulator 24 sends a signal to the control device 15 causing it to actuate the stopper rod 14 so as to compensate for a deviation of $\overline{M}$=−0.5 mm from the set level 16. The value of $\Delta h_{max}$ (which is equal to −5 mm) is not taken into account.

b) If the sensor 17 measures $h_1$=70 mm and the sensor 18 measures $h_2$=91 mm, then $(h_1-h)$=−5 mm and $(h_2-h)$=+16 mm. Therefore $\Delta h_{max}$=+16 mm and $\overline{M}$=+5.5 mm. Since $|\overline{M}|$=5.5 mm is greater than $diff_{max}$, the regulator 24 then sends a signal to the control device 15 causing it to actuate the stopper rod 14 so as to compensate for a deviation of $\Delta h_{max}$=+16 mm from the set level 16.

c) If the sensor 17 measures $h_1$=70 mm and the sensor 18 measures $h_2$=85 mm, then $(h_1-h)$=−5 mm and $(h_2-h)$=+10 mm. Therefore $\Delta h_{max}$=+10 mm and $\overline{M}$=+2.5 mm. Since $|\overline{M}|$=2.5 mm lies between $diff_{min}$ and $diff_{max}$, it is necessary to calculate $$\alpha=\frac{2.5-1}{5-1}=0.375.$$

The regulator 24 then sends the control device 15 a signal causing it to actuate the stopper rod 14 so as to compensate for a deviation of $$\alpha\Delta h_{max}+(1-\alpha)M=0.375\times10+(1-0.375)\times2.5=5.3\text{ mm}$$

from the set level 16.

It will be recalled that the mode of combining the signals from the sensors 17, 18 which has just been explained constitutes merely one example, and other modes of combining may be envisaged. Likewise, the numerical values quoted for the operating parameters for the conditioning and combining devices are merely examples and have to be adjusted depending on the local conditions of each machine according to the quality of the results obtained.

As a variant, it could also be possible to dispense with the operation of digitizing the signals coming from the sensors 17, 18 before treating them and to condition and combine them by purely analog means. However, it goes without saying that it would not be possible to regulate with the same precision and, above all, not possible to modify rapidly, as required, the various operating parameters of the installation, such as, for the conditioning device, the width of the dead band and the cutoff frequency of the filter, and, for the combining device, the parameters $diff_{min}$ and $diff_{max}$.

Likewise, all types of sensors delivering an electrical signal as a function of their distance from the meniscus, and not just eddy-current sensors, may be used.

Moreover, it is perfectly conceivable to use several pairs of sensors, distributed over the length of the mold, if greater precision in detecting the irregularities in the level of the meniscus is desired. It is also possible to use such a device on a square mold for casting blooms or billets.

Finally, it goes without saying that the regulating device described can also be used on a continuous casting machine in which the flow rate of liquid steel leaving the tundish is regulated by a device other than a stopper rod, for example a nozzle with a slide valve.

We claim:

1. A method for regulating the level of the meniscus of liquid metal in a mold of a machine for the continuous casting of metals, comprising the steps of picking up electrical signals supplied by at least one pair of sensors overhanging said meniscus, said signals being a function of the respective distances ($h_1$, $h_2$) between said sensors and said meniscus; combining these two signals so as to obtain a single signal representing an imaginary level of said meniscus, and sending said single signal to means for controlling a device for regulating the flow rate of metal penetrating the mold, so that said device brings said imaginary level of said meniscus back to a predetermined set value (h), wherein each signal coming from said sensors is conditioned by eliminating therefrom oscillations having both a frequency greater than a threshold (F) and an amplitude less than a threshold (D).

2. The method as claimed in claim 1, wherein, on combining said signals emitted by said sensors:

the quantity $$\left(\overline{M}=\frac{h_1+h_2-2h}{2}\right)$$

and its absolute value ($|\overline{M}|$) are calculated;

($|\overline{M}|$) is compared to two predetermined values ($diff_{min}$) and ($diff_{max}$), where $diff_{min}<diff_{max}$;

if $|\overline{M}|\leqq diff_{min}$, said imaginary level is taken to be equal to $\overline{M}$;

if $|\overline{M}|\geqq diff_{max}$, said imaginary level is taken to be equal to a value ($\Delta h_{max}$) which is the higher in absolute value of the quantities [($h_1$−h), ($h_2$−h)];

if $diff_{min}<|\overline{M}|<diff_{max}$, said imaginary level is taken to be equal to $\alpha\Delta h_{max}+(1-\alpha)\overline{M}$, α being equal to $$\frac{(|\overline{M}|-diff_{min})}{(diff_{max}-diff_{min})}.$$

3. The method as claimed in claim 1, further comprising the step of putting the signals coming from said sensors into digital form and performing said conditioning and combining operations on said signals thus digitized.

4. The method as claimed in claim 1, wherein the threshold (F) is taken to be equal to 0.02 Hz.

5. The method as claimed in claim 1, wherein the threshold (D) is taken to be equal to 3 mm.

6. A device for regulating the level of the meniscus of liquid metal in a mold of a machine for the continuous casting of metals, comprising at least one pair of sensors overhanging said meniscus, each of these sensors delivering a signal representing its distance ($h_1$, $h_2$) from said meniscus, means for combining said signals and for delivering a single signal representing an imaginary level of said meniscus to means for controlling a device for regulating the flow of the liquid metal penetrating the mold, which combining means also includes means for conditioning said signals before combining them, so as to eliminate therefrom undulations having both a frequency greater than a threshold (F) and an amplitude less than a threshold (D).

7. The device as claimed in claim 6, which comprises means for digitizing said signals emitted by said sensors and wherein said means for conditioning and combining said signals are digital processing means.

8. The device as claimed in claim 6, wherein said sensors are eddy-current sensors.

* * * * *